United States Patent [19]

Schadow

[11] 4,144,419

[45] Mar. 13, 1979

[54] PUSH-BUTTON ACTUATED SLIDE SWITCH

[75] Inventor: Rudolf Schadow, Berlin, Fed. Rep. of Germany

[73] Assignee: ITT Industries, Inc., New York, N.Y.

[21] Appl. No.: 785,507

[22] Filed: Apr. 7, 1977

[30] Foreign Application Priority Data

Apr. 28, 1976 [DE] Fed. Rep. of Germany ..... 2618572

[51] Int. Cl.[2] ..... H01H 15/00

[52] U.S. Cl. ..... 200/16 R; 200/153 LA; 200/159 R

[58] Field of Search ..... 200/5 E, 5 EA, 5 EB, 200/11 D, 16 C, 16 D, 153 J, 153 LA, 159 R, 314, 1 R, 5 R

[56] References Cited

U.S. PATENT DOCUMENTS

| | | | |
|---|---|---|---|
| 2,821,580 | 1/1958 | Black | 200/11 D X |
| 3,120,584 | 2/1964 | Grunfelder et al. | 200/5 E |
| 3,189,695 | 6/1965 | Randolph | 200/11 D |
| 3,189,696 | 6/1965 | Nuttall | 200/11 D |
| 3,488,460 | 1/1970 | Baumanis | 200/16 D |
| 3,722,313 | 3/1973 | Schadow | 200/5 E X |
| 3,739,110 | 6/1973 | Constable | 200/5 EB X |
| 3,757,060 | 9/1973 | Tanuzzi et al. | 200/16 C |
| 3,843,852 | 10/1974 | Lockard | 200/16 D |
| 3,882,056 | 5/1975 | Nakasone | 200/16 C |

*Primary Examiner*—James R. Scott

*Attorney, Agent, or Firm*—James B. Raden; William J. Michals

[57] ABSTRACT

A push-button actuated slide switch for a key board with noise suppression contacts arranged in the mounting area of the switch. These additional contacts are arranged perpendicular to the fixed contacts of the switch and bridged by a contact bridge which is indirectly actuated by the slider of the switch.

3 Claims, 5 Drawing Figures

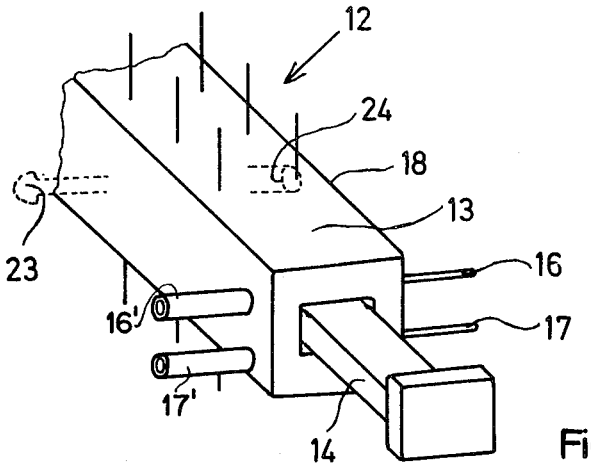
Fig.1
Fig. 2
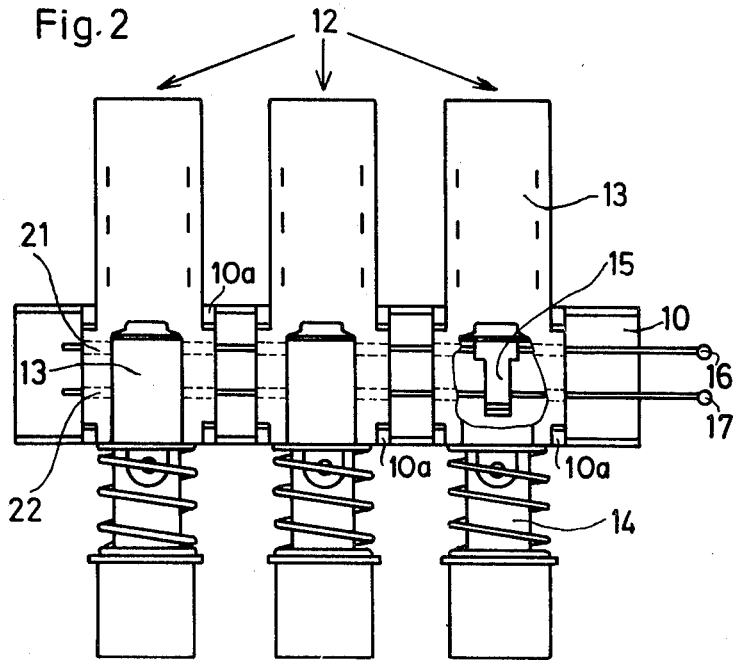

PUSH-BUTTON ACTUATED SLIDE SWITCH

BACKGROUND OF THE INVENTION

The present invention relates to a pushbutton actuated slide switch comprising at least one row of fixed contacts arranged behind each other in the sliding direction, which project on one side or on two opposite sides as terminals out of the housing, and are capable of being electrically bridged by contact bridges connected to the slider.

The electrical contacts of such pushbutton actuated slide switches are arranged on the slider at a fixed spaced relation, and serve the switching in proportion to the slider movement, as bridging contacts between the fixed contacts arranged in a row. Owing to the fixed arrangement in the order of sequence of the individual contacts, it is only possible to perform a synchronous switching. It is also desirable, however, for the slider to actuate other asynchronously switchable contacts. For this purpose it has been proposed to attach to one end of a pushbutton actuated slide switch, a pushbutton switch whose contact bridge is actuated as well as by the slider of the pushbutton actuated slide switch.

It is the object of the invention to provide a pushbutton actuated slide switch with additional contacts which are capable of being actuated as well by the slider of the pushbutton actuated slide switch. These additional contacts are to be integrated in a simple as possible manner into the overall structure of a pushbutton actuated slide switch. Moreover, the additional contacts are arranged in such a way as to cooperate simultaneously with the corresponding additional contacts of pushbutton actuated slide switches arranged next to each other.

Whereas in the normal design, the fixed contacts are aligned in such a way as possibly not to affect one another in the case of pushbutton actuated slide switches arranged next to each other, a common function is actually required in the case of the additional contacts. This applies in particular to noise suppression contacts which are intended to shorten the output amplifier input upon actuation of each key of the keyboard of an amplifier for the noise-suppressions purpose.

SUMMARY OF THE INVENTION:

With respect to a pushbutton actuated slide switch of the type mentioned hereinbefore, this object is achieved in that at least two additional contacts are provided whose terminals project at least on one side out of the housing, and are staggered by 90° with respect to the row of terminals. Preferably, the additional contacts may be capable of being bridged by a contact bridge which is influenced by the slider but not directly connected thereto.

These additional contacts may be advantageously inserted into the housing of the pushbutton actuated slide switch together with the bridge contact, and actuated via recesses or projections provided for on the slider. The lateral position of the terminals may simultaneously be utilized for effecting the mechanical mounting of several pushbutton actuated slide switches next to each other, for which purpose the contacts are to be led out as male contacts on one side, and as female contacts on the other side.

Advantageously, several pushbutton actuated slide switches may be provided with one common wire contact which is inserted through the housing and cut after having been dimensioned correspondingly. Advantageously, also the metallic holding arrangement of a pushbutton assembly for pushbutton actuated slide switches may be used as well for serving as a common electrical connection, for which purpose it is also suitable to use locking bars of the laterally displaceable type.

BRIEF DESCRIPTION OF THE DRAWING:

The invention will now be explained in greater detail with reference to examples shown in FIGS. 1 to 5 of the accompanying drawings, in which:

FIG. 1 perspectively shows a pushbutton actuated slide switch comprising one pair of additional contacts, FIG. 2 shows three pushbutton actuated slide switches assembled to form one aggregate.

Figure 3:
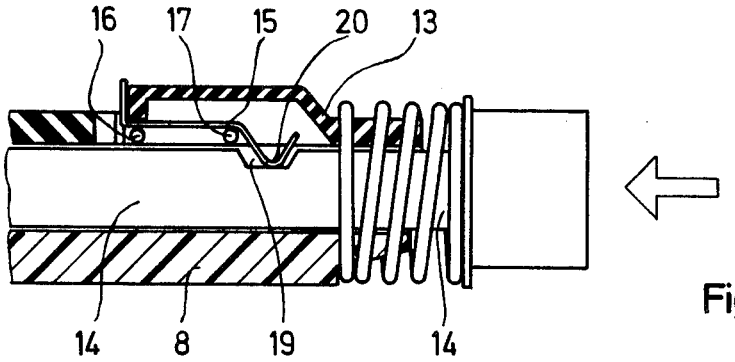
FIGS. 3 and 4 show cross sectional views of a pushbutton actuated slide switch with one additional contact in the on-, and one additional contact in the off-state.

DETAILED DESCRIPTION:

The pushbutton actuated slide switch 12 as shown in FIG. 1 consists of a housing 18 of insulating material, in which fixed contacts are arranged in one row behind each other and which, by contact bridges, and with the aid of the slider 14, can be either brought into an electrical connection with each other, or separated. In addition to the row of fixed contacts, additional contacts 16, 17 are arranged, according to the invention, on one side in the housing 18 of the pushbutton actuated slide switch, by which a contact bridge 15 either on the slider 14 or inside the housing 18 can be brought into contact with one another. One individual contact bridge 15 can be retained in position by a cover portion 13 which, in turn, is held in position by the slider reset spring.

Figure 4:
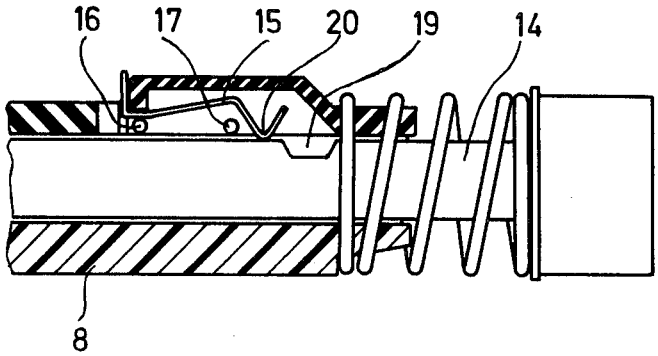

The contacts may also be arranged crosswisely inside the housing, i.e. in such a way that they are directly brought into connection in a flexible way by the slider. One example of embodiment of the bridge contact 15 is shown in FIGS. 3 and 4.

The additional contacts are led out on the right hand side in FIG. 1 as male contact pins, and on the left hand side as female contacts 16' and 17', so that several pushbutton actuated slide switches can be arranged next to each other by being plugged into one another. For providing a further mechanical assistance to this mounting arrangement, it is still possible to use snap-in-type projections or openings 23 and 24, as indicated at the rear end of the switch body by the dashlines.

Several pushbutton actuated slide switches are often combined with the aid of a U-shaped bar 10 to form a pushbutton assembly 10, as is shown in FIG. 2.

The individual switches are respectively mounted to bar 10 by way of bent-over tabs **10*a* which are integrally formed with bar 10. These pushbutton actuated slide switches are provided with openings 21 and 22 through which, parallel in relation to the mechanical holding arrangement and through the U-shaped member 10, additional contacts are inserted in the form of wires 16, 17. The pushbutton actuated slide switch as shown in the right hand portion of FIG. 2, is in such a way broken on its surface as to permit the contacting points of the wires 16, 17** as lying behind each other, to become visible.

Instead of only utilizing wires 16 and 17, female contacts 16' and 17' disposed on the left hand side of each switch (as illustrated in FIG. 1) could also be utilized.

FIGS. 3 and 4, in a cross sectional view, each show one pushbutton actuated slide switch forming part of the pushbutton assembly shown in FIG. 2, in which identical parts are indicated by the same reference numerals. In these representations, the electrical connection of the wires 16 and 17 becomes visible, which is effected by a contact bridge 15 mounted inside the housing. This contact bridge 15 is designed to have the shape of a spring resting with a sharp bent portion on the slider of the pushbutton actuated slide switch, only connecting the wires 16, 17 when the spring 15 engages a recess 19 in the slider. In another slider position, as shown in FIG. 4, the bent portion rests in such a way on the slider, that the two wires 16, 17 are electrically insulated from one another.

The electrical connection between the wires 16, 17 can be so adjusted, in dependence upon the slider path, that the recess 19 on the slider is made correspondingly large and disposed at a suitable point. A readjustment, if necessary, is possible by displacing the bent portion 20 of the spring by way of rebending.

As additional contacts 16, 17 it is also possible to use stamped parts in that the bridge contact spring 15 is shaped to form one piece with the stamped part 16.

Figure 5:
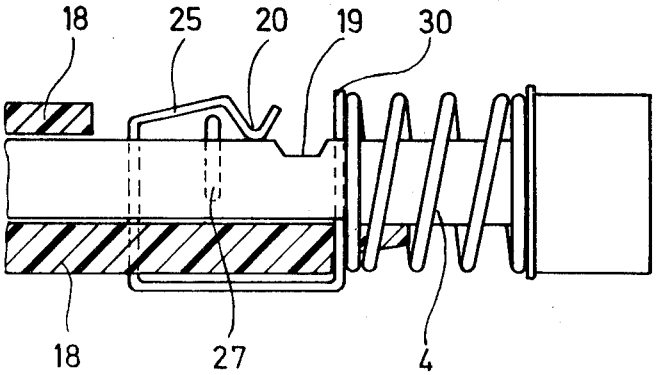
FIG. 5 is the cross sectional view of parts of a pushbutton actuated slide switch in which the mechanical mounting means are used as well for serving as additional contacts.

With the aid of such pushbutton actuated slide switches 12 as shown in FIG. 1 it is actually possible to equip a pushbutton assembly mechanically. In addition thereto, it is often still required to provide for a mutual interlocking as well. For the purpose of providing this mutual locking it would be necessary to provide a bar in the arrangement shown in FIG. 2. This bar can be simultaneously used for the additional contacts, as is shown in the sectional view of FIG. 5. In this drawing, there are shown parts of a pushbutton actuated slide switch in a cross sectional view, in which the already explained individual parts are indicated by the same reference numerals. The additional contacts of this pushbutton actuated slide switch consist of the U-shaped bar 30 and of a spring 25 shaped thereto, and provided with a corresponding bent portion 20, and of a further bar 27. The bridge contact spring 25 is actuated by the slider when in the corresponding recess position 19.

The second contact 27, in addition thereto, may still perform other mechanical functions which occur in this range of the pushbutton actuated slide switch. It might, for example, effect a mutual locking or interlocking (engagement) of individual keys, in that it is provided with corresponding recesses or projections for each individual key. For this purpose, such interlocking bars are elastically supported on one side with the aid of springs, opposite a stationary part of the housing. The electrical connection of the addition contacts is established in the most simple case, at the mounting spring and at one point on the U-shaped bar.

It will be appreciated by those skilled in the art that it is also possible to use as additional contacts, on one hand, a wire which is capable of being inserted and, on the other hand, only one mounting bar. In all cases it is essential for the proper functioning of the invention, that the position thereof extends transversely in relation to the direction in which the slider is actuated.

What is claimed is:

1. A pushbutton actuated slide switch comprising, in combination:

an elongated longitudinally extending insulated switch housing;

a switch plunger slidably mounted in said housing for reciprocal movement in the longitudinal direction of said housing;

a plurality of contacts fixedly mounted to said housing at the generally inner end portion thereof;

a pushbutton head mounted to the outer end of said plunger for translating said plunger within said housing;

at least one conductive bridging element mounted to the generally inner end portion of said plunger for engaging a pair of said contacts when said plunger is translated to a corresponding position;

a pair of auxiliary contacts mounted to said housing and extending from housing transversely of said longitudinal direction;

a resilient auxiliary bridging element mounted to said housing and yieldably biased toward said auxiliary contacts for engaging said auxiliary contacts; and, means cooperating with said plunger for disengaging said auxiliary bridging element from at least one of said auxiliary contacts when said plunger is translated to a corresponding position.

2. The switch according to claim 1, wherein said auxiliary bridging element includes a projection which engages a cam surface of said plunger wherein said surface translates said auxiliary bridging element away from said one of said auxiliary contacts when said plunger is translated to a corresponding position.

3. The switch according to claim 2, wherein said surface of said plunger includes a recess which receives a bent portion of said projection of said auxiliary bridging element when said plunger is in a corresponding position.

* * * * *